US006546594B1

(12) United States Patent
Wills

(10) Patent No.: US 6,546,594 B1
(45) Date of Patent: Apr. 15, 2003

(54) SANITARY AND DISPOSABLE COVERS FOR USE WITH DOOR KNOBS AND DOOR HANDLES

(76) Inventor: Steven Wills, 34521 Utica Rd., Fraser, MI (US) 48062

( * ) Notice: Subject to any disclaimer, the term of this patent is extended or adjusted under 35 U.S.C. 154(b) by 0 days.

(21) Appl. No.: 09/931,452

(22) Filed: Aug. 16, 2001

(51) Int. Cl.[7] ..... E05B 1/04

(52) U.S. Cl. ..... 16/114 R; 16/422; 16/435; 16/904; 206/233; 248/905; 221/48

(58) Field of Search ..... 16/904, 422, 435; 206/233; 248/905; D06/578

(56) References Cited

U.S. PATENT DOCUMENTS

| | | | | | |
|---|---|---|---|---|---|
| 1,493,557 | A | * | 5/1924 | Meadoff | 379/452 |
| 2,781,220 | A | * | 2/1957 | Zietlow | 292/347 |
| 3,711,024 | A | * | 1/1973 | Hammond | 239/55 |
| 4,046,508 | A | | 9/1977 | McDonald | 21/77 |
| 4,559,671 | A | | 12/1985 | Andrews et al. | 16/111 R |
| 4,644,689 | A | | 2/1987 | Arians | 49/70 |
| 4,658,469 | A | | 4/1987 | Hawkins | 16/110 R |
| 4,710,634 | A | | 12/1987 | Brookes | 250/455.1 |
| 4,725,489 | A | * | 2/1988 | Jones et al. | 428/289 |
| 4,856,140 | A | | 8/1989 | Visco et al. | 16/114 R |
| 4,869,305 | A | * | 9/1989 | Jones | 150/155 |
| 4,921,028 | A | | 5/1990 | Schwartz | 150/155 |
| 4,976,299 | A | | 12/1990 | Bickelman | 150/155 |
| 4,997,139 | A | | 3/1991 | Menard | 242/67.1 R |
| 5,008,551 | A | | 4/1991 | Randolph | 250/462.1 |
| 5,048,718 | A | * | 9/1991 | Nakamura | 221/35 |
| 5,117,807 | A | * | 6/1992 | Graulich | 126/190 |
| 5,215,319 | A | * | 6/1993 | Farris | 280/33.992 |
| 5,314,668 | A | | 5/1994 | Biermaier | 422/292 |
| 5,713,615 | A | | 2/1998 | Tsai | 292/347 |
| 5,840,122 | A | | 11/1998 | Williams | 118/505 |
| 5,884,996 | A | | 3/1999 | Cottone et al. | 362/399 |
| 5,938,069 | A | * | 8/1999 | Macchia | 221/48 |
| 5,983,454 | A | | 11/1999 | Hartselle, III | 16/412 |
| 5,987,645 | A | | 11/1999 | Teaster | 2/159 |
| 6,068,820 | A | * | 5/2000 | DeGuzman | 422/294 |
| D427,046 | S | * | 6/2000 | Mannix | D8/322 |
| 6,189,183 | B1 | | 2/2001 | Hartselle, III | 16/412 |
| 6,189,730 | B1 | * | 2/2001 | McClymonds | 221/46 |
| 6,213,424 | B1 | * | 4/2001 | Helfer-Grand | 242/564.1 |
| 6,346,153 | B1 | * | 2/2002 | Lake et al. | 118/423 |

* cited by examiner

*Primary Examiner*—Anthony Knight
*Assistant Examiner*—Lisa Bannapradist
(74) *Attorney, Agent, or Firm*—Gifford, Krass, Groh, Sprinkle, Anderson & Citkowski, P.C.

(57) ABSTRACT

A covering device for use with a door handle and interconnecting shaft extending from a hingedly secured door. The device includes an elasticized body having a substantially three dimensional shape with an inner face, an outer face, and an open inserting end defined around a narrowed neck of the body. The body further including a flexible and plasticized material which may be covered by a soft fabric outer layer. A resilient retaining portion, such as an elasticized ring is disposed around the neck in association with the open inserting end and for securing the body in place over the door handle and shaft. Frictional engagement is provided between the inner face of the elasticized body and the door handle surface in use and is preferably provided as an adhesive tacking surface which may be incorporated into an inner ply of covering device or spray applied. A portable and carryable dispenser holds, in compressed fashion, a plurality of individual and elasticized bodies provides for the selective dispensing of individual ones of the bodies.

14 Claims, 6 Drawing Sheets

SANITARY AND DISPOSABLE COVERS FOR USE WITH DOOR KNOBS AND DOOR HANDLES

BACKGROUND OF THE INVENTION

1. Field of the Invention

The present invention relates generally to door knob and handle covers. More particularly, the invention is directed to sanitary elasticized covering members for use with door knobs and door handles and which provides the advantages of portability and carry-ability in multiple numbers, as well as ease of use and disposability.

2. Description of the Prior Art

The prior art is well documented with various types of door knob covering devices. The purposes of such prior art devices vary from multiple uses including painting, illuminating during night-time or darkness applications, decorative applications, as well as sanitary aspects. A more detailed description of each such prior art application will now be made as follows.

U.S. Pat. No. 4,856,140, issued to Visco et al., discloses a sanitary handle cover for either a door knob or toilet handle. The cover is disclosed as including a cup-like portion defining a pocket for insertingly receiving the knob or handle in close frictional engagement. A constricted neck portion extends or projects from the pocket to cover the mounting shaft of the knob or handle and, if desired, a band retainer is employed for holding the cover in place. A plurality of slits or openings are provided through the material, permitting the user's fingers to grab limited surface areas of the knob or handle allowing knob turning. Visco further discloses employing a disinfectant in its porous material and which is specifically adapted to be slidably engaged over the knob or handle in order to act as a barrier between the fingers of a person and the possible contaminated surface of the knob or handle.

While professing a degree of effectiveness in combating germs and other types of bacteria, Visco appears relatively limited to either door knob or toilet handle configurations of specified size and configuration, and in large measure due to the requirement that it be produced in the substantially cup-shaped manner. The shaping of the Visco cover further prevents it from being easily transported in portable fashion or carried in multiple dispensing fashion. The material used in the cover is further disclosed as being composed of a porous craft paper or other suitable sheet material which would further seem to compromise the integrity of the device in sealing germs away from contact with the user's hand.

Furthermore, the provision of slits in the cover design, to enable the user to grip the surface of the door handle at certain locations, would seem to largely overcome its professed objective of providing sanitary protection to the user. Along these lines, the argument in favor of the slits in Visco avers that sliding contact of the exposed portions defining the boundaries of the slits, and which are impregnated with disinfectant substance, would act to continually re-sanitize the exposed portions. The truth is that the disinfectant portion would tend to wear over any significant period of time and is a poor second to hermetically sealing of the handle or knob from user's hands.

U.S. Pat. No. 4,921,028, issued to Schwartz, teaches a cover for door hardware which has a plastic sheet adhesively attached to the base of the door hardware and to cover the door hardware while painting. Rather than utilizing an elastic band, as taught in Visco, a side adhesive strip attaches the paint covering to the door handle. U.S. Pat. No. 5,840,122, issued to Williams, teaches another type of door knob cover for enclosing a knob during painting and includes a particularly escutcheon shaped and spherical resilient knob cover assembly for positioning over the door knob.

U.S. Pat. No. 5,713,615, issued to Tsai, teaches a stretchable door knob cover constructed of a soft cloth-like material, shaped similar to a door knob and including a spherical head, narrower neck and wider base. Openings along the neck of the cover and the flexibility of the material allow the base and neck of the cover to stretch and fit over a door knob. A string is laced through the neck of the door knob cover and tied tightly to secure the cover on the door knob and so that it cannot be removed by pulling. The underside of the cover is coated with a layer of rubber-like material that promotes friction against the surface of the door knob and to allow easy operation of the knob without the cover slipping. The basis of the Tsai device is to provide both decorative and anti-shock aspects and, due to its cloth construction, would not provide any significant degree of sanitary protection.

Finally, U.S. Pat. No. 5,008,551, issued to Randolph, discloses a phosphorescent luminous door knob cover molded from an admixture of a phosphorescent powder and a carrier. A first half of the cover overlies a first half of a door knob and the first half of the door knob neck when the device is operatively installed. A second half of the cover overlies a second half of the door knob and the second half of the door knob neck when the device is operatively installed. A hinge is formed in the cover to facilitate placing it on and removing it from door knobs and an annular band secures the cover to the door knob.

SUMMARY OF THE PRESENT INVENTION

The present invention is a sanitary elasticized covering member for use with door knobs and door handles and which provides the advantages of portability, carry-ability in multiple dispensability. The elasticized covering member of the present invention is further an advantage over the prior art in that it provides the user with the ability to quickly dispense a covering member from a packet container, such as tissue-like box or elongated cylindrical container, and to cover an existing door handle, knob, lever and the like. The present invention is further an additional improvement over the prior art in that it permits the user to easily and portably carry a number of the covering members for quick affixation (and removal) from door handles.

The covering device includes an elasticized body having a substantially three dimensional shape with an inner face, an outer face, and an open inserting end defined by a narrowed neck. The elasticized body further includes at least a single ply of flexible and plasticized material and, in a preferred variant, further includes an outer layer of a soft fabric (cotton) material. It is further envisioned that the outer layer of fabric material may be spray applied using flocking technology known in the art and in order to permit the underlying ply or layer the necessary stretchability or flexibility to configure about any conventionally shaped door knob or ornately shaped handle.

An elasticized ring is disposed around the open neck for assisting in securing the body in place over the handle and shaft and it is also envisioned that, in alternate applications, releasably engageable portions such as VELCRO® portions may be provided in place of the elasticized ring. An adhesive tacking material is further preferably applied to the inner face of the body for adhering against the door handle surface and may include either an impregnated or spray-applied composition. A disinfecting, deodorizing and/or scenting material may further be coated upon the inner face of said elasticized body, perhaps in combination with the tacking material. Alternatively, the disinfecting material, as with the tacking material, may be impregnated into the plasticized composition of the elasticized body.

A portable and carryable dispenser is provided for holding in compressed fashion a plurality of individual and elasticized bodies. The dispenser is provided in one embodiment as a substantially rectangular and tissue-shaped dispenser with a slitted top surface. In a further preferred variant, the dispenser includes an elongated and cylindrical shaped enclosure with a replaceable lid which permits selective dispensing of individual ones of five or more covering devices. A volume of an alcohol solution may further be provided in suitable dispensing apparatus and which may conveniently be stored within the cylindrical shaped enclosure along with the compressingly disposed and held elasticized bodies.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
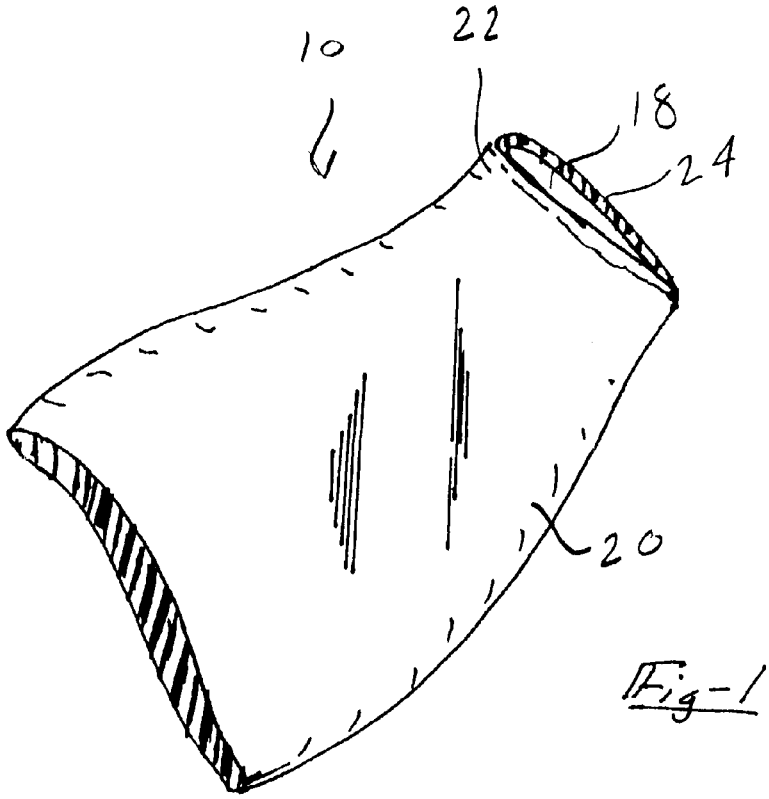
FIG. 1 is a perspective view of the door handle cover according to a first preferred embodiment of the present invention.

Referring now to FIG. 1, a sanitary and elasticized cover is illustrated at 10 for use with an existing door knob or handle according to the present invention. As previously described, the elasticized covering member of the present invention is an advantage over the prior art, which teaches three dimensionally configured covering members, in that it provides the user with the ability to quickly dispense a covering member from a packet container, such as tissue-like box or elongated cylindrical container, and to cover an existing door handle, knob, lever and the like. The present invention is further an additional improvement over the prior art in that it permits the user to easily and portably carry a number of the covering members for quick affixation (and removal) to and from a number of handles of succeeding doors and such as would be normally encountered in public places and the like.

Figure 2:
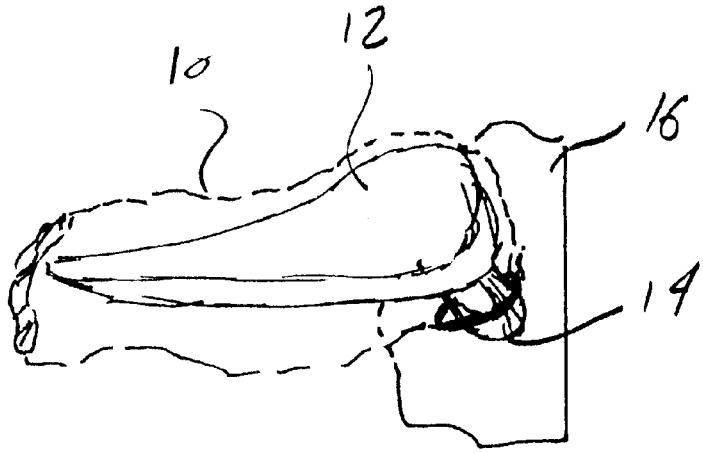
FIG. 2 is an environmental view illustrating the cover of FIG. 1 applied to a uniquely and ornamentally configured door handle.

As is best further illustrated in reference to FIG. 2, a conventional door handle is illustrated in one known configuration at 12 and is in the shape of a decorative lever with the covering device 10 (illustrated in phantom) in applied fashion over the handle 12. The lever shaped handle 12 further includes an interconnecting shaft 14 extending from a hingedly secured door 16 (illustrated partially). As will be described in more detail, the covering device of the present invention, as set forth in the varying embodiments, is capable of being applied to any of a plurality of differently configured door handles (knobs, levers, etc.) within the scope of the present invention. Alternatively, it is envisioned to be within the scope of the invention that the covering devices can be packaged in pluralities of differing sizes to accommodate the different types and sizes of door knobs and levers.

Referring again to FIG. 1, the covering device 10 includes an elasticized and compressible/flattenable body having a substantially three dimensional shape with an inner face 18, an outer face 20, and an open inserting end defined by a narrowed neck portion 22. The body of the covering device, in a preferred embodiment, defines a substantially rubberized or plasticized material, preferably opaque or transparent, and which may be elastically stretched so as to apply around the configuration of the door handle/lever and so that the narrowed portion 22 encircles the interconnecting shaft portion 14.

The elasticized body is resiliently retained over the door lever 12 through the utilization, in the first embodiment, of an elasticized or rubberized ring 24. The ring 24 is similar in regards to a rubber band and may consist of any suitable type of elasticized material necessary to conform the shape of the narrowed neck portion 22 and the body around the door handle.

Figure 3:
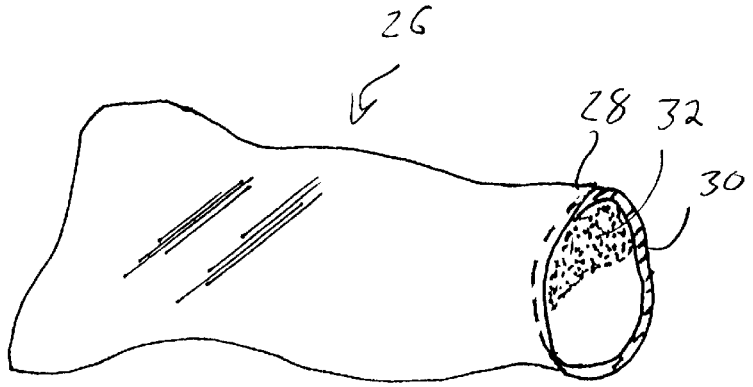
FIG. 3 is a perspective view of a slightly modified cover and further illustrating the tacky/adhesive nature of its inner surface.

Referring to a slightly modified variant of the covering device in FIG. 3, at 26, a substantially elastic/compressible, plasticized and three dimensionally shaped body is again illustrated and which again shows a narrowed neck portion 28 with an open inserting end defined by an elasticized and retaining ring 30. An additional feature of the covering device is further the provision of an adhesive/tacking material 32 upon the inner face. The tacking material 32 may be selected from any frictionally engaging/grit type material and the purpose of which is to engage against the exterior surfaces of the door knob or lever during turning of the door with the covering device in place.

It is further envisioned that the tacking material 32 may be applied as a continuous coating to the inner face of the covering device, such as sprayed or flocked in any conventional manner known in the art. Alternatively, it is also envisioned that the tacking material 32 may be impregnated into the material of the covering device 26 and so as to be exposed to the inner face. An additional advantage of the covering devices of the present invention, as will be described subsequently in additional detail, is the ability of the device to completely and hermetically cover and seal exposed (and potentially germ contaminated) surfaces of the door knob, while still permitting the knob to be engaged and turned with the covering device in place.

Figure 5:
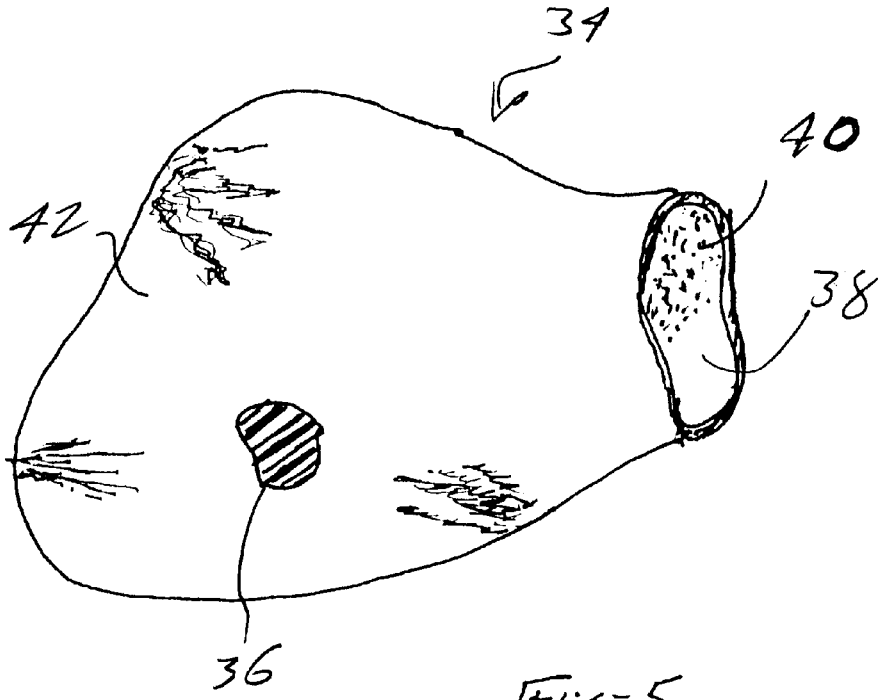
FIG. 5 is an illustration of a further modified cover and illustrating the combination of an outer ply fabric layer combined with an inner ply and plasticized layer.

Referring now to FIG. 5, a further variant of the covering device is illustrated at 34 and discloses a two-ply elasticized device including a first elastic/plasticized inner ply (see at partial cutaway at 36 and exposing an inner face 38) and upon which is applied an adhesive/tacking material 40. An outer layer or ply is represented at 42 which defines the outer face and which is preferably a soft fabric or cotton type material. In order for the covering device to substantially maintain is elasticized properties, the outer fabric/cotton layer may be applied once again by flocking or spraying the particles onto the initial/inner plasticized ply 34 of material and so that the underlying structural characteristics of this material are maintained, i.e., the fabric particulates will adhere primarily to the plasticized layer and not to each other, thus providing the appearance of a continuous fabric layer while maintaining the elastic properties of the covering device. It is also envisioned that additional and other types of organic and inorganic particulates which mimic the appearance and consistency of fabric can be utilized and without departing from the scope of the present invention.

As will also be described in more detail, a scenting/deodorizing or, preferably, a disinfecting material is desirously applied to the covering device and preferably upon the inner face thereof. The particular use of the disinfecting material is intended to kill off as many germs as possible adhering to the exposed surfaces of the door knob and in attempt to provide the maximum degree of protection to the user.

Figure 6:
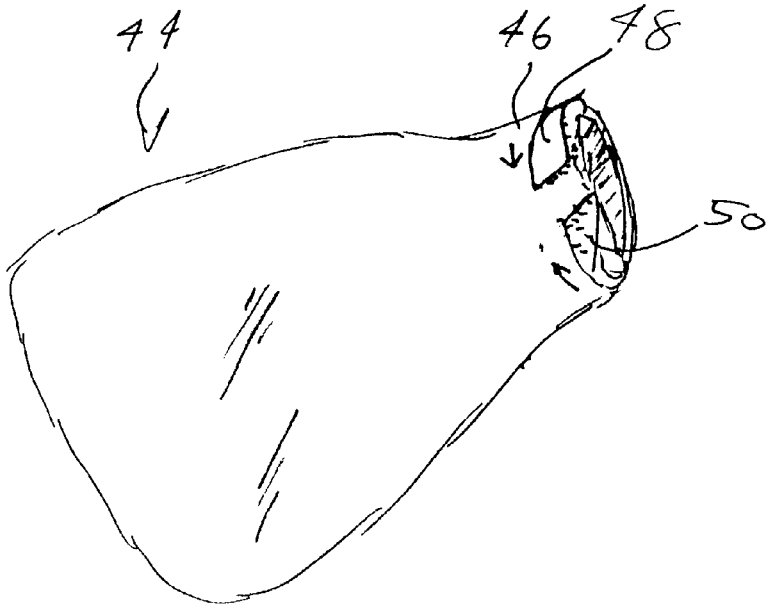
FIG. 6 is an illustration of a further variant of the present invention and showing the provision of Velcro attachments for securing the device to an existing door knob or handle.

Referring now to FIG. 6, a yet further variant of the covering device of the instant invention is again shown and which again includes a three dimensional, substantially elasticized body of material 44 defining the inner and outer faces and with a narrowing neck 46 representing the open inserting end. A variation resilient retaining structure, from the elasticized ring 24 of FIG. 1, is illustrated in the form of an encircling band of releasably engageable portions such as VELCRO® portions having first and second extending portions 48 and 50, the portions 48 and 50 interengaging with one another after the narrowed neck portion 46 is elastically fitted about the door knob or lever and to assist in holding the device 44 in place. As was previously stated, other and additional types of retaining structure can be employed for holding the covering device onto the door knob or lever and without departing from the scope of the invention.

Figure 4:
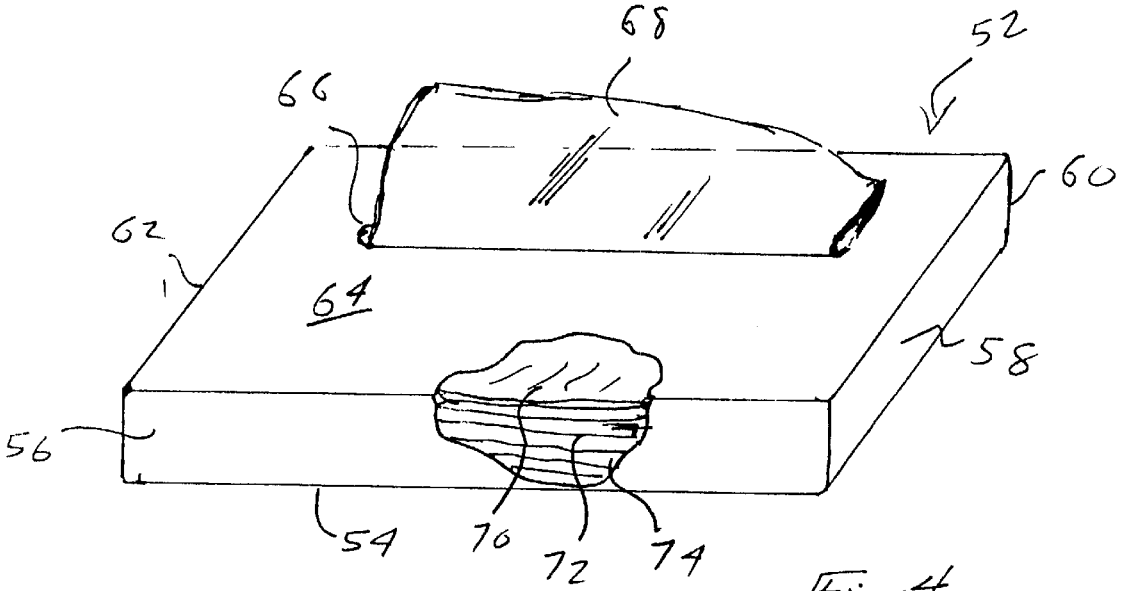
FIG. 4 illustrates one variant of a multiple dispenser in the form of a tissue-like enclosure according to the present invention.

Referring to FIG. 4, a first variation of a dispenser is illustrated generally at 52 for holding and selectively dispensing a plurality of individual covering devices. As previously stated, the covering devices (according to any preferred embodiment of the invention) are substantially compressible such that a plurality may be maintained in a portable and easily transportable fashion.

As illustrated in the selected variation of FIG. 4, the dispenser 52 includes a substantially rectangular shaped and three-dimensional enclosure with a bottom 54, four interconnecting sides 56, 58, 60 and 62 and a top surface 64. A slit 66 is defined in the top surface 64 and so that each of the plurality of elasticized bodies/covering devices being held in sideways arrayed and compressed fashion within said enclosure. In particular, a first dispensed covering device is illustrated at 68, with additional devices being held in compressed and ready to dispense fashion (see at 70, 72, 74, et. seq. revealed by the cutaway section in the enclosure) within the internal confines of the tissue-like dispenser 52.

Figure 8:
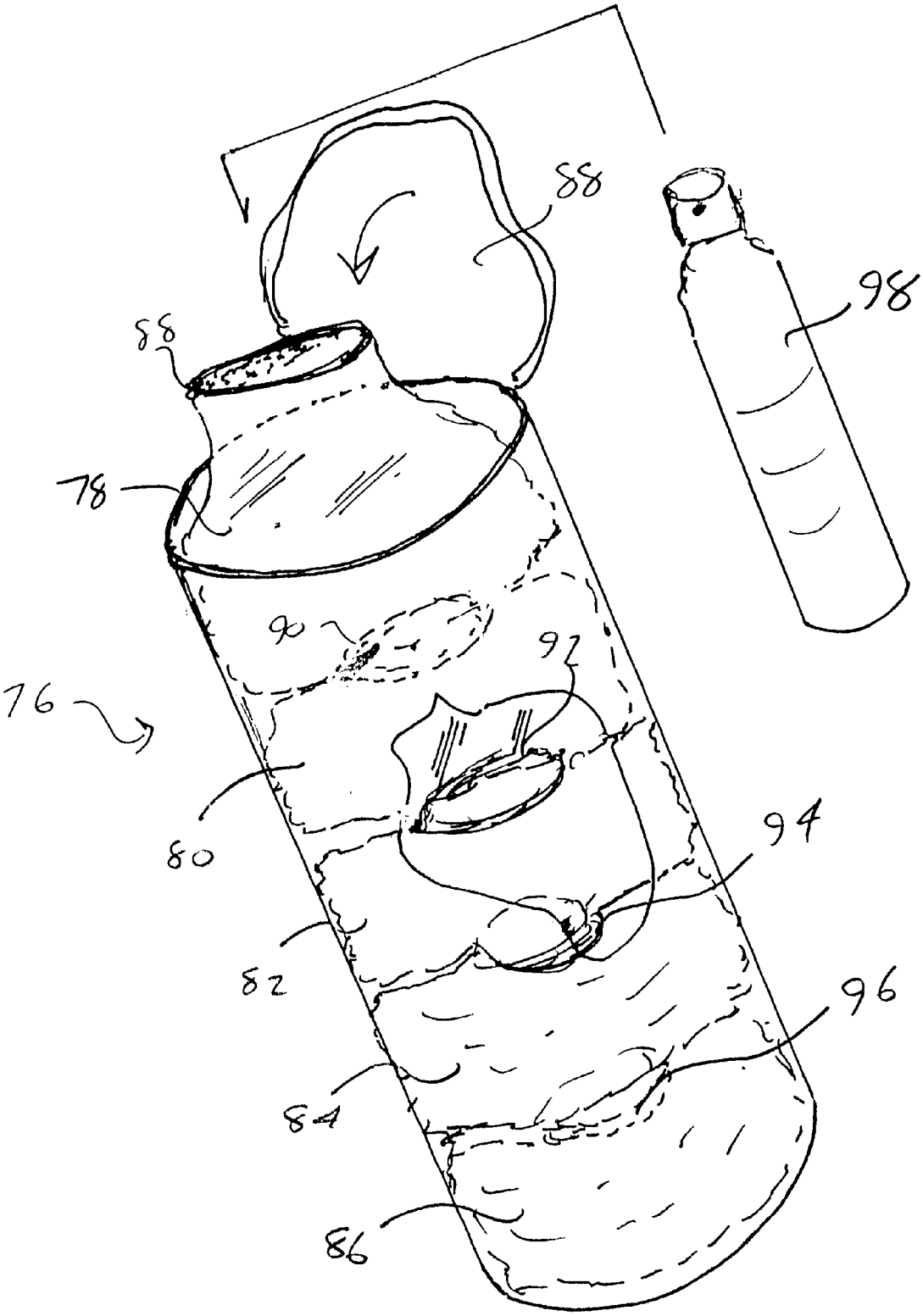
FIG. 8 is an illustration of a further variant of a multiple dispenser in the form of a generally cylindrical container with an openable and reclosable top and according to the present invention.

A further preferred variant of a multi-dispenser is illustrated at 76 in FIG. 8 and which is provided in the form of a substantially cylindrical, elongated, portable and carryable dispenser for holding, in compressed fashion, a plurality of individual and elasticized bodies, represented at 78, 80, 82, 84, and 86. The dispenser 76 includes an open top upon which is secured a replaceable lid 88 for permitting selective dispensing of individual ones of the bodies 78, 80, 82, 84 and 86.

Each of the covering devices is further held in upwardly facing fashion within the cylindrical dispenser 76, and as evidenced by the arrangement of the narrowing neck/elastic ring portions 88, 90, 92, 94 and 96 corresponding respectively to each of the succeeding covering devices 78, 80, 82, 84 and 86. A volume of an alcohol solution may also be provided, which is maintained within a suitable and portable dispensing apparatus 98 (such as a smaller sized spray or mist applicator) and which is both carried within and accessible from the cylindrical shaped dispenser/enclosure 76, along with the plurality of compressingly disposed and elasticized bodies corresponding to the covering devices 78–86.

In this fashion, a preferred application of the present invention is made possible, that being the ability of the user to portably carry a plurality of the covering devices (usually at least five or more) within a suitable dispensing device and to then apply each of the covering devices to each of a succeeding plurality of individual door handles, such as is typical in public places. The simplicity of construction of the present invention covering devices is further such that they may be disposable after limited use and, accordingly, the manufacturing processes and materials employed in constructing the covering devices, as well as the type of coating disinfectants and adhesive/tacking materials, can be selected with this consideration in mind.

Figure 7:
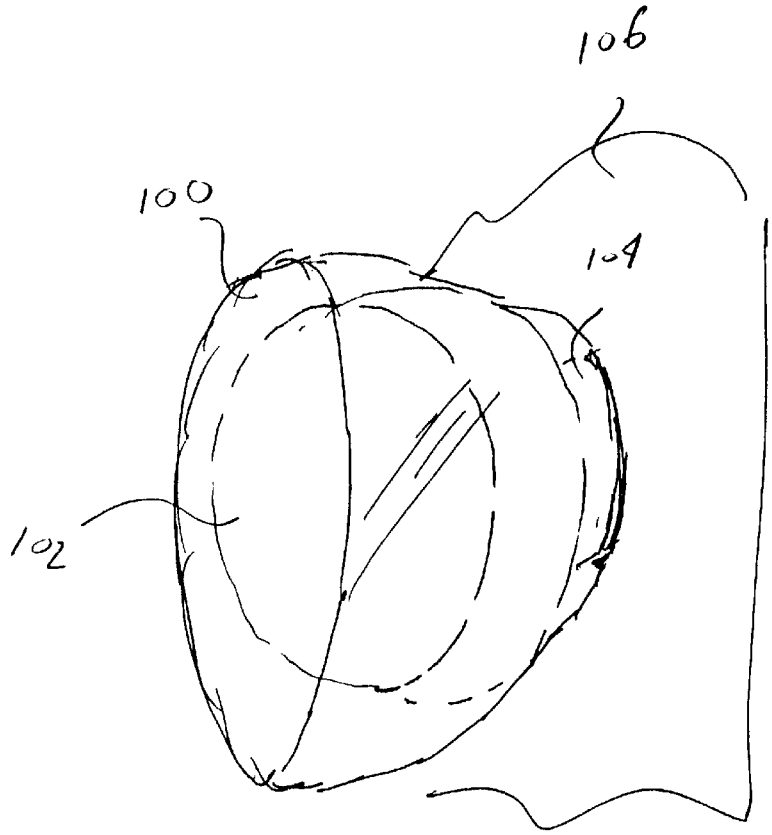
FIG. 7 is an environmental view, similar to that previously illustrated in FIG. 2, and generally representing any of the previously disclosed covers applied to a conventionally configured door knob.

Referring to FIG. 7, a yet further variation of a covering device 100 is shown in applied fashion over another conventional type of door handle, this being an existing and substantially knob-shaped handle 102, again including an interconnecting shaft 104 extending from a hingedly secured door 106. The purpose of the representation of the covering device 100 is intended to reinforce the understanding that the device may be configured in varying shapes and sizes, as well as being constructed with varying degrees of flexibility and elasticity, so that the device 100 may be quickly and effectively secured over any of a plurality of differently sized and configured door handles, knobs and levers.

Figure 9:
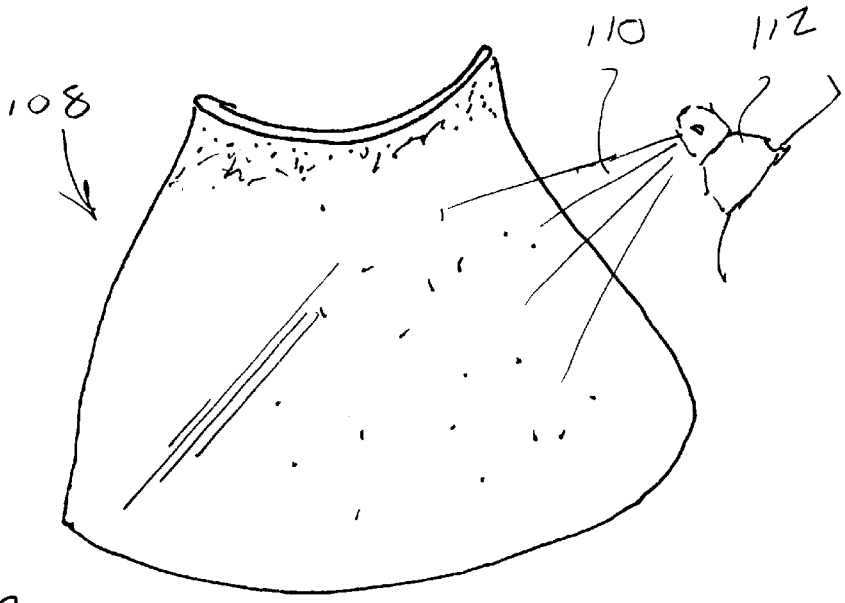
FIG. 9 illustrates a selected cover provided as a substantial blank shape and further illustrating one preferred manner in which a deodorant, disinfectant and/or scenting solution is coated on one or both selected sides of the cover.

Referring to FIG. 9, a variation of elasticized body is illustrated as a substantially flattened blank 108. Any of a number of different manufacturing processes may be employed for producing the covering device of the present invention and the pre-configuration in the blank shape provides but one alternative for efficient coating of the disinfectant material 110, such as again through the use of a flocking or spray applicator 112, and prior to subsequent formation of the blank into a substantially three dimensional shape using a conventional joining process.

Figure 11:
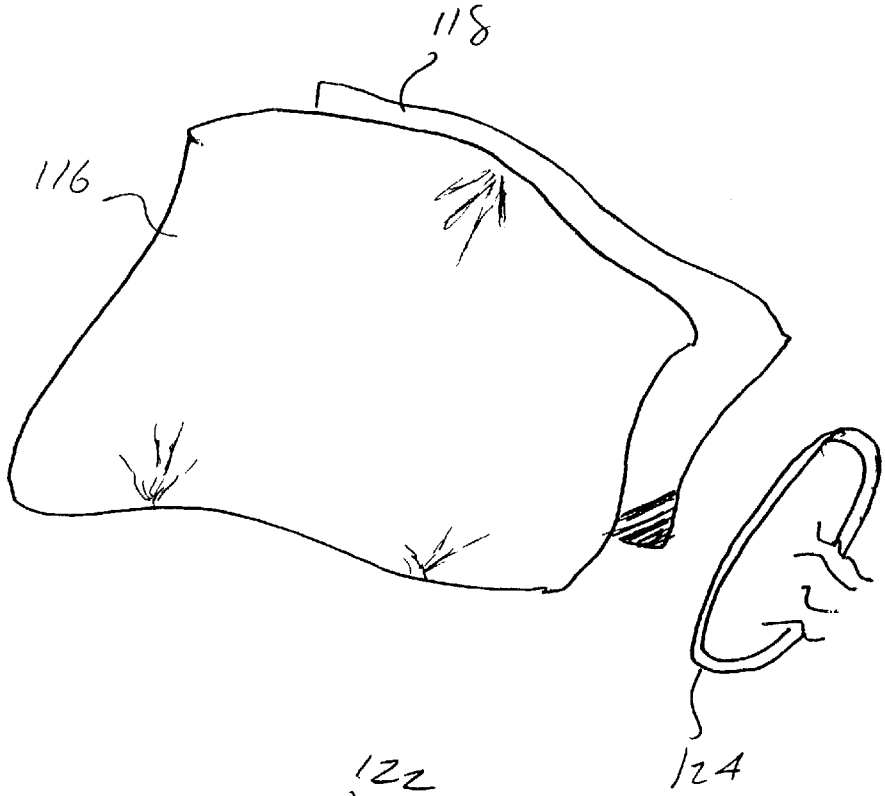
FIG. 11 illustrates an exploded view of the variant of FIG. 10.
Figure 10:
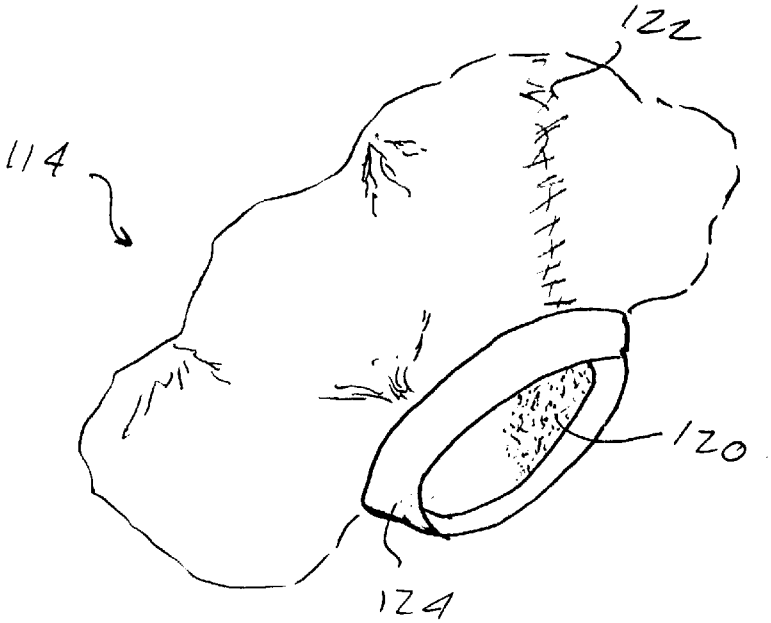
FIG. 10 illustrates a further variant of the covering device with the sewn outer fabric and inner elastic layer.

Referring finally to FIGS. 10 and 11, a yet further preferred variant of the present invention is disclosed at 114 and which again includes provision of a first outer layer of a fabric material 116 and a second inner layer 118 of an elastic material. The covering devices of the embodiment are again flexible and compressible and form a substantially hairnet configuration. As in previous embodiments, the inner layer 118 exposes an inner face with an adhesive or tacking material 120 applied thereto and a further feature of the alternative embodiment contemplates that the two layers are sewn together, such as represented by stitching 122. An elastic band 124 is secured around an open end of the formed outer 116 and inner 118 layers and completes the assembly. As with previous embodiments, a disinfectant or deodorant composition (such as again a spray) may be applied to the assembled covering device, such as to an exterior surface of the fabric outer layer 116.

Having described my invention, additional preferred embodiments will become apparent to those skilled in the art to which it pertains and without deviating from the scope of the appended claims.

I claim:

1. A covering device for use with a door handle having a door handle surface and interconnecting shaft extending from a hingedly secured door, said device comprising:

an elasticized and fully sealed body having a substantially three dimensional shape with an inner face, an outer face, and an open inserting end;

a dispenser for holding and selectively dispensing a plurality of said elasticized bodies, said dispenser further comprising a substantially rectangular shaped enclosure having a slitted top surface, each of said plurality of elasticized bodies being held in sideways arrayed and compressed fashion within said enclosure;

resilient retaining means associated with the open inserting end for securing said body in place over the handle and shaft; and frictional engaging means associated with said inner face for adhering said elasticized body to the door handle surface in use.

2. The device as described in claim 1, said body further comprising a flexible and plasticized material.

3. The device as described in claim 2, said flexible and plasticized material further comprising an inner ply, said body further comprising an outer ply of a soft fabric material.

4. The device as described in claim 1, said open inserting end of said body further comprising a narrowed neck, said resilient retaining means further comprising an elasticized ring disposed around said neck.

5. The device as described in claim 1, said open inserting end of said body further comprising a narrowed neck, said resilient retaining means further comprising a hook and pile fastener disposed around and extending from said neck.

6. The device as described in claim 1, said frictional engaging means further comprising an adhesive tacking material applied to said inner face.

7. The device as described in claim 1, further comprising a disinfectant material coated upon said inner face of said elasticized body.

8. The device as described in claim 1, further comprising a deodorizing material coated upon said inner face of said elasticized body.

9. The device as described in claim 1, further comprising a scenting material coated upon said inner face of said elasticized body.

10. The device as described in claim 7, further comprising said elasticized body being provided as a substantially flattened blank prior to said coating of disinfectant material and subsequent formation into said substantially three dimensional shape.

11. The device as described in claim 1, said body having a specified size and configuration and being substantially transparent.

12. A covering device for use with a door handle having a door handle surface and interconnecting shaft extending from a hingedly secured door, said device comprising:

an elasticized and fully sealed body having a substantially three dimensional shape with an inner face, an outer face, and an open inserting end, said body further comprising a flexible and plasticized material;

resilient retaining means associated with the open inserting end for securing said body in place over the handle and shaft;

frictional engaging means associated with said inner face for adhering said elasticized body to the door handle surface in use; and a portable and carryable dispenser for holding in compressed fashion a plurality of individual and elasticized bodies, said dispenser permitting selective dispensing of individual ones of said bodies.

13. A covering device for use with a door handle having a door handle surface and interconnecting shaft extending from a hingedly secured door, said device comprising:

an elasticized and fully sealed body having a substantially three dimensional shape with an inner face, an outer face, and an open inserting end defined by a narrowed neck, said body further comprising a single ply of flexible and plasticized material and an outer ply of cotton lining;

an elasticized ring disposed around said neck for securing said body in place over the handle and shaft;

an adhesive tacking material applied to said inner face for adhering said elasticized body to the door handle surface in use;

a disinfectant material coated upon said inner face of said elasticized body; and a portable and carryable dispenser for holding in compressed fashion a plurality of individual and elasticized bodies, said dispenser further comprising an elongated and cylindrical shaped enclosure with a replaceable lid and permitting selective dispensing of individual ones of said bodies.

14. The covering device as described in claim 13, further comprising a volume of an alcohol solution maintained within a suitable and portable dispensing apparatus and which is both carried within and accessible from said cylindrical shaped enclosure along with said plurality of compressingly disposed and elasticized bodies.

* * * * *